United States Patent [19]

Ishii et al.

[11] 4,319,550

[45] Mar. 16, 1982

[54] ENGINE STOP APPARATUS

[75] Inventors: Yoshiya Ishii, Toyota; Nobuyuki Fujitani, Kariya; Hidetoshi Dohshita, Okazaki, all of Japan

[73] Assignee: Nippondenso Co., Ltd., Kariya, Japan

[21] Appl. No.: 142,818

[22] Filed: Apr. 22, 1980

[30] Foreign Application Priority Data

May 11, 1979 [JP] Japan ..... 54-58539

[51] Int. Cl.[3] ..... F02D 17/00

[52] U.S. Cl. ..... 123/198 DB; 123/198 D; 123/333

[58] Field of Search ..... 123/198 DB, 198 D, 196 S, 123/333

[56] References Cited

U.S. PATENT DOCUMENTS

| | | | |
|---|---|---|---|
| Re. 27,108 | 3/1971 | Johnson, Jr. et al. | 123/198 DB |
| 2,734,496 | 2/1956 | Hammond | 123/198 DB |
| 4,150,654 | 4/1979 | Heitzman et al. | 123/198 DB |
| 4,252,094 | 2/1981 | Draxler | 123/198 DB |

*Primary Examiner*—Charles J. Myhre
*Assistant Examiner*—Andrew M. Dolinar
*Attorney, Agent, or Firm*—Cushman, Darby & Cushman

[57] ABSTRACT

An electromagnetic selector valve for changing the fuel paths between the fuel tank, fuel supply pump and fuel injection pump of an engine is energized by an energization control unit including a monostable multivibrator only for a predetermined time interval just after the engine key switch has been turned off. An on-off valve disposed in the pipe line between the fuel tank and the electromagnetic selector valve or the pipe line between the electromagnetic selector valve and the fuel injection pump, is opened during the time the engine is operating. When necessary, the on-off valve is continuously opened by another energization control unit including a monostable multivibrator for a predetermined time interval just after the engine key switch has been turned off.

8 Claims, 9 Drawing Figures

ENGINE STOP APPARATUS

BACKGROUND OF THE INVENTION

1. Field of the Invention

The present invention relates to an apparatus for stopping an engine having a fuel injection pump.

2. Description of the Prior Art

Referring to FIG. 1 showing a known type of engine stop apparatus, an electromagnetic selector valve 1 is designed so that when an engine is in operation, a fuel tank 2 is connected to an inlet 3*a* of a fuel supply pump 3 and a fuel injection pump 4 is connected to an outlet 3*b* of the fuel supply pump 3 as shown in the Figure. During the stopping operation, the electromagnetic selector valve 1 connects the fuel injection pump 4 to the inlet 3*a* of the fuel supply pump 3 and the outlet 3*b* of the fuel supply pump 3 to the fuel tank 2. Numeral 5 designates a fuel injection nozzle, 6 a fuel filter, and 7 to 11 fuel lines. In this way, with the engine in operation, the fuel supply pump 3 supplies the fuel to the fuel injection pump 4 from the fuel tank 2 to thereby continue the engine operation, and during the stopping operation of the engine the fuel is returned to the fuel tank 2 from the fuel chamber (not shown) of the fuel injection pump 4 so that the fuel injection from the fuel injection pump 4 is stopped and the engine is stopped. In this case, while the electromagnetic selector valve 1 may be replaced with any type other than the electromagnetic type, it is the usual practice to use an electromagnetic valve for the selectro valve 1 in cases where the engine is automatically stopped by simply turning the key switch off or any malfunction of the engine such as the reverse operation is automatically detected to automatically stop the engine.

In the case of large engines, however, due to the high rate of fuel flow as well as the restrictions imposed by the cross-section area of the flow passages, the electromagnetic selector valve 1 must have a stroke of about 10 mm if it is of the spool valve type or a rotational angle of over 45° if it is of the rotary valve type. Thus, in this case a large value is required for the output of the actuator (solenoid) of the electromagnetic selector valve 1 and the actuator must be increased in size and current consumption (over 10 A).

In the case of Diesel engines, with the engine at rest the electromagnetic selector valve 1 must always be held in the stop position due to the existence of a problem that unless the fuel supply is cut off when the engine is at rest, there is the danger of the engine being automatically started by an external force (e.g., due to a rear-end collision or downward movement along a slope). Thus there is a disadvantage that the actuator of the electromagnetic selector valve 1 must always be energized either while the engine is in operation or at rest, with the result that if the valve 1 is designed so as to energize the actuator while the engine is at rest, there is the danger of causing the battery to run down, and if it is designed to energize the actuator while the engine is in operation, the actuator must be increased in size to prevent the generation of heat therein and the use of a high-output generator is also required.

SUMMARY OF THE INVENTION

It is the object of this invention to provide an improved engine stop apparatus capable of ensuring a reduced power consumption while maintaining the essential functions of automatically stopping an engine and preventing any undesired starting of the engine by an external force.

DESCRIPTION OF THE PREFERRED EMBODIMENTS

The present invention will now be described in greater detail with reference to the illustrated embodiments.

Figure 1:
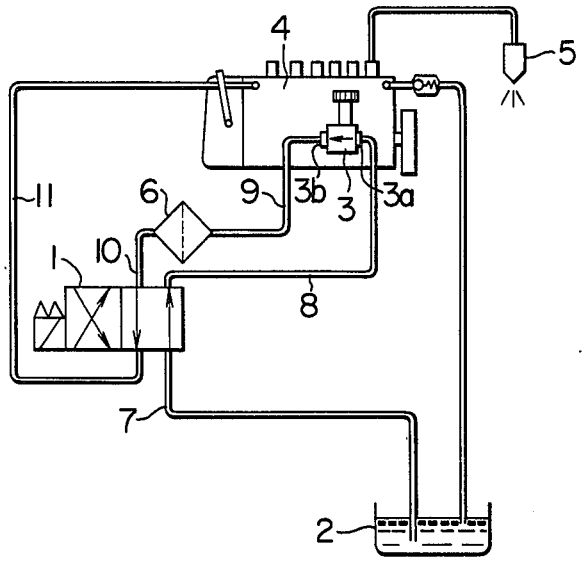
FIG. 1 PRIOR ART
FIG. 1 is a schematic diagram showing the construction of a prior art apparatus.
Figure 2:
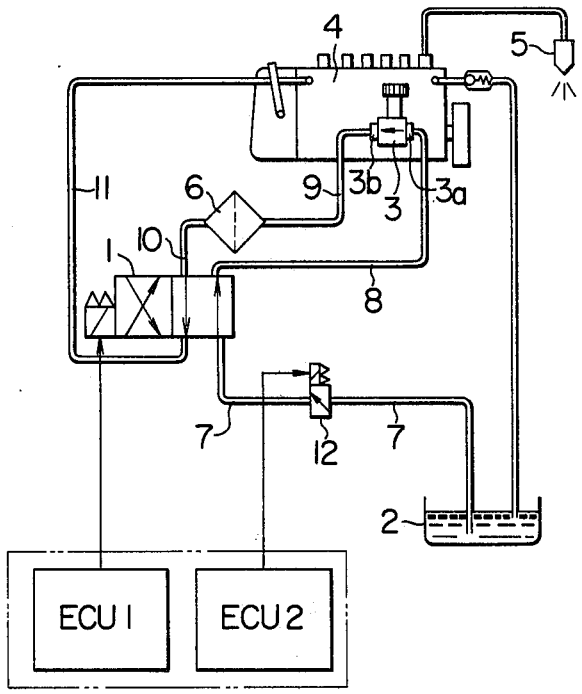
FIG. 2 is a schematic diagram showing the construction of an embodiment of an apparatus according to the invention.

Referring to FIG. 2 showing the overall construction of an embodiment of the invention, numerals 1 to 11 designate components which are identical with their counterparts in the prior art apparatus of FIG. 1 except that an electromagnetic on-off valve 12 for opening and closing the fuel passage in the fuel line 7 is mounted in the fuel line 7 connecting the electromagnetic selector valve 1 to the fuel tank 2. As will be described later, the electromagnetic on-off valve 12 has a function as a check valve so that when closed it allows only the fuel flow to the fuel tank 2. In the Figure, designate at ECU1 is an energization control unit for controlling the electromagnetic selector valve 1 and ECU2 an energization control unit for controlling the electromagnetic on-off valve 12. ECU1 and ECU2 are arranged on the same board.

Figure 3:
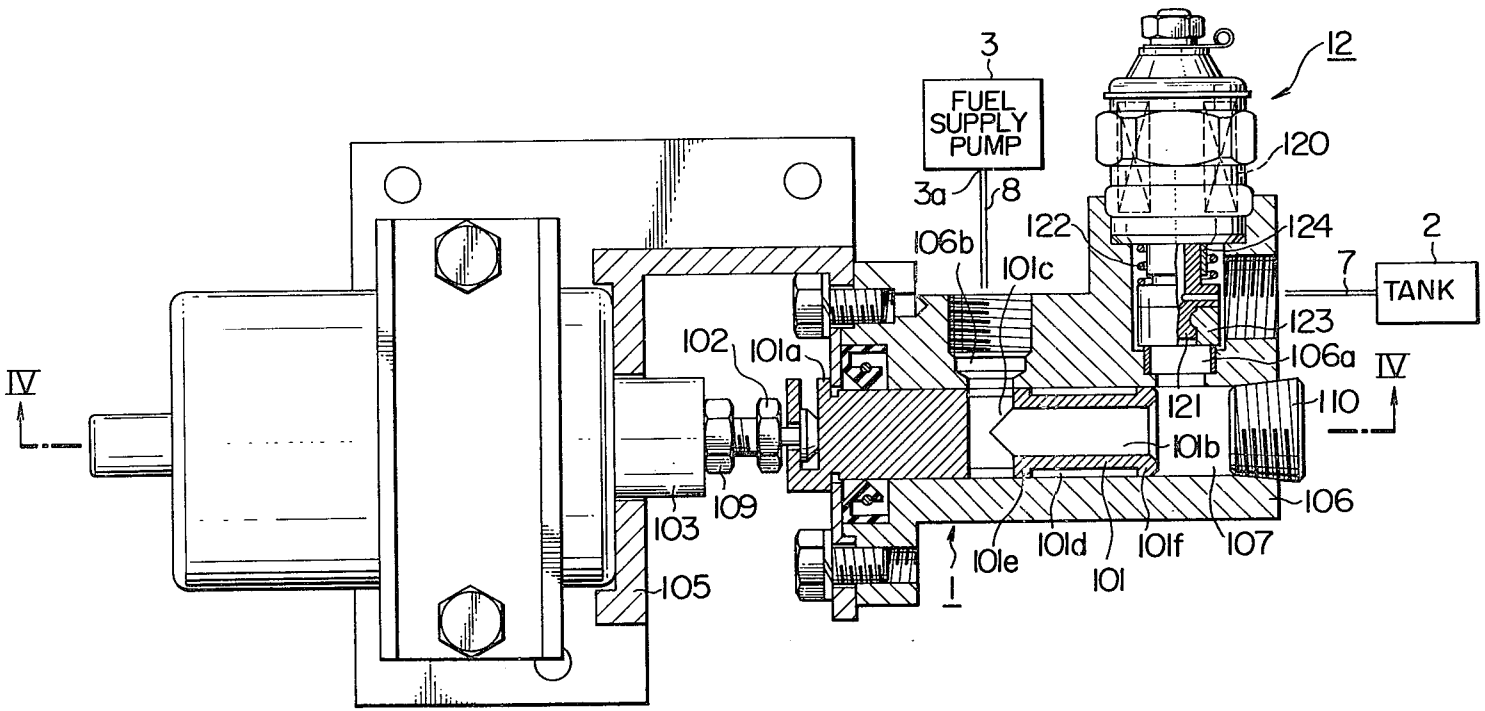
FIG. 3 is a sectional view of the electromagnetic selector valve 1 shown in FIG. 2.
Figure 4:
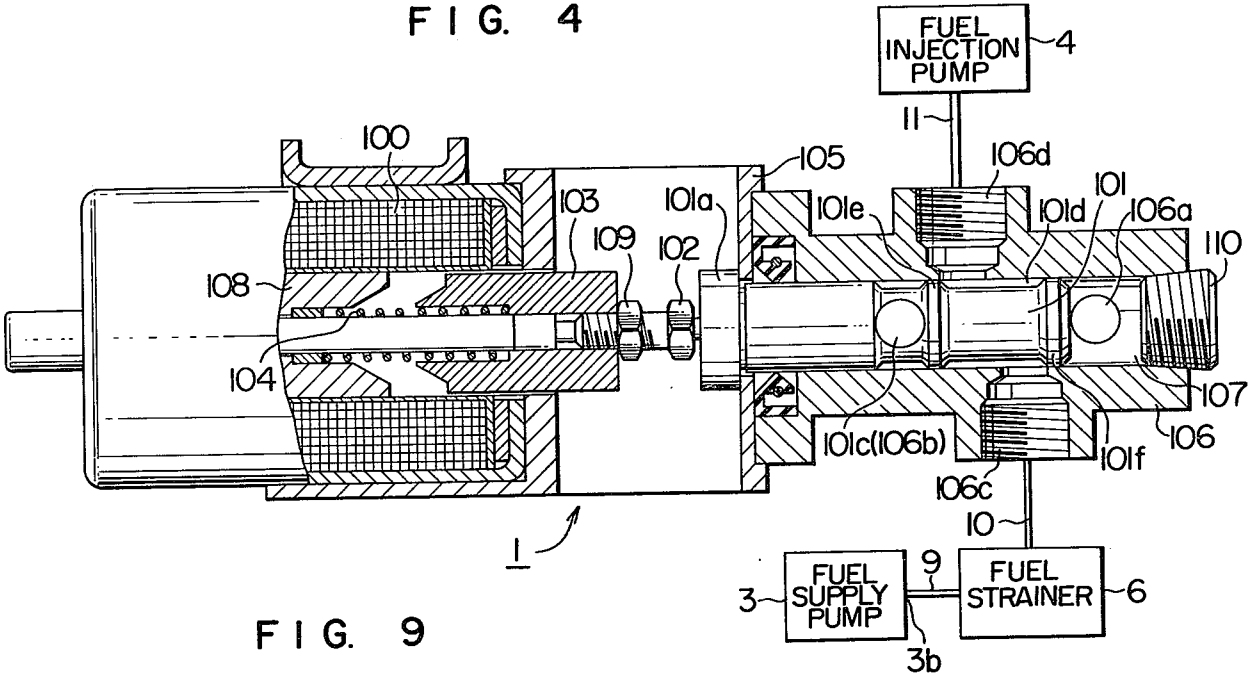
FIG. 4 is a sectional view taken along the line IV—IV of FIG. 3.

FIGS. 3 and 4 show in detail the construction of the electromagnetic selector valve 1 comprising a four-port two-position spool valve and the electromagnetic on-off valve 12 having a function as a check valve, and they are assembled as a unit. In operation, when a coil 100 (FIG. 4) of the selector valve 1 is not energized, a spool 101 is biased to the right by a spring 104 by means of an adjusting bolt 102 and a plunger 103 so that a collar 101*a* of the spool 101 abuts against a casing 105 to determine its position (the position shown in FIGS. 3 and 4). Thus, in FIG. 3, the fuel flows to the inlet 3*a* of the fuel supply pump 3 from the fuel tank 2 through the line 7, a passage 106*a* in a valve body 106, a spool chamber 107, an axial opening 101*b* in the spool 101, a port 101*c* of the spool 101, a passage 106*b* in the body 106 and the line 8. Then, in FIG. 4, the fuel flows further from the outlet 3*b* of the fuel supply pump 3 to the fuel injection pump 4 by way of the line 9, the filter 6, the line 10, a passage 106*c* in the body 106, an outer peripheral groove 101*d* of the spool 101, a passage 106*d* in the body 106 and the line 11.

On the other hand, when the coil 100 of the selector valve 1 is energized, the plunger 103 and the spool 101 are attracted against the spring 104 and they are moved to the left until the plunger 103 abuts against a stator 108. In this case, it is adjusted by means of the adjusting bolt 102 threadedly fitted to the plunger 103 so that the spool 101 is positioned properly relative to the body 106, that is, a first ring portion 101*e* of the spool 101 is moved past the passage 106*b* and a second ring portion 101*f* of the spool 101 is positioned intermediate between the passages 106*c* and 106*d*. Thus, the fuel in the fuel injection pump 4 flows to return to the fuel tank 2 by way of the line 11 (FIG. 4), the outer peripheral groove 101*d* of the spool 101, the passage 106*b*, the line 8 (FIG. 3), the inlet 3*a* of the fuel supply pump 3, the outlet 3*b* (FIG. 4), the line 9, the filter 6, line 10, the passage 106*c*, the spool chamber 107, the passage 106*a* (FIG. 3) and the line 7. Numeral 109 designates a lock nut, and 110 a blank plug.

Referring to FIG. 3, the on-off valve 12 is integrally assembled to the body 106 of the selector valve 1, so that when its coil 120 is not energized, as shown in the Figure, a plunger 121 is biased downwardly by a spring 122 so that a valve member 123 attached to the plunger 121 comes into contact with the body 106 and the line 7 is disconnected with the passage 106*a*. When the coil 120 is energized, the plunger 121 and the valve member 123 are attracted upwards against the spring 122 and the line 7 is connected with the passage 106*a*. When the valve 12 is in the closed position, the valve 12 is opened only when a pressure is applied to the plunger 121 and the valve member 123 from the passage 106*a* side so that they are moved upward against the spring 122. Numeral 124 designates a guide for the plunger 121.

Figure 5:
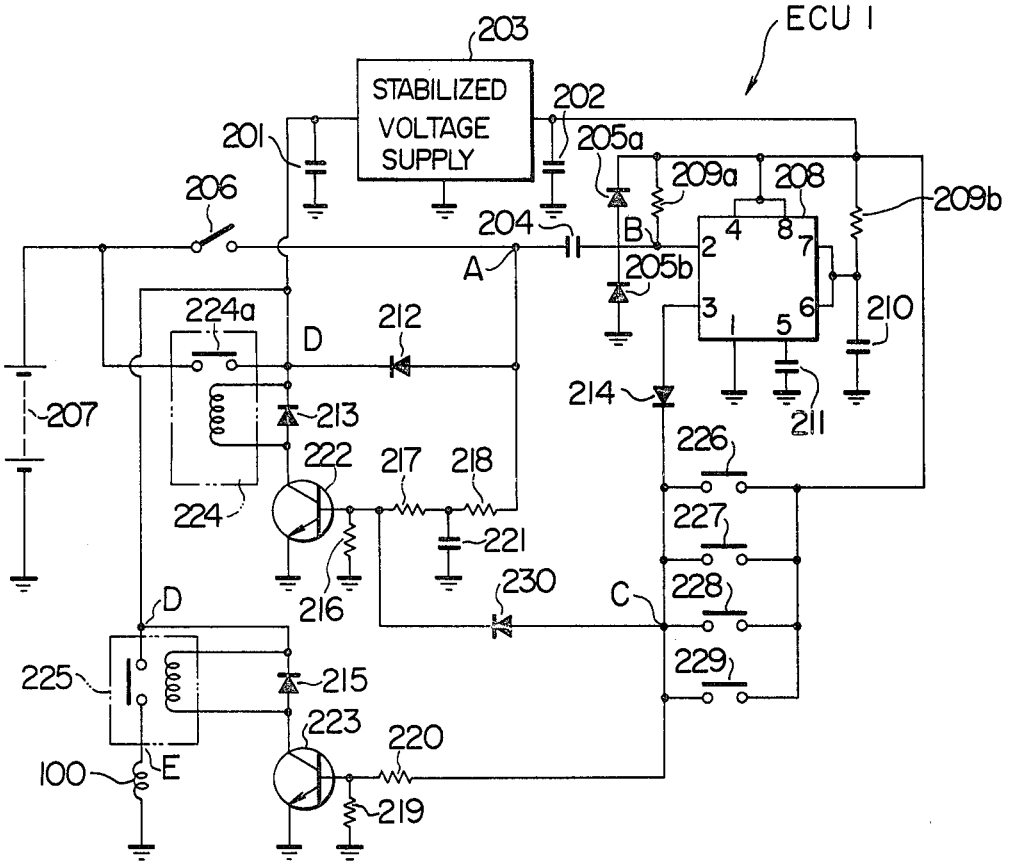
FIG. 5 is a circuit diagram showing an embodiment of the energization control unit ECU1 for the electromagnetic selector valve 1 shown in FIG. 2.

Referring to FIG. 5, the first energization control unit ECU1 for the coil 100 of the electromagnetic selective valve 1 comprises mainly a stabilizing supply circuit, a monostable multivibrator and a relay drive circuit. The stabilizing supply circuit comprises smoothing capacitors 201 and 202 and a known type of stabilizing supply IC 203, and the monostable multivibrator comprises a differentiating capacitor 204, diodes 205*a* and 205*b*, a monostable multivibrator IC 208, a resistor 209*a*, an externally connected resistor 209*b* and capacitors 210 and 211.

The relay drive circuit comprises diodes 212 to 215, resistors 216 to 220, a capacitor 221, transistors 222 and 223, normally-open relays 224 and 225 and a diode 230.

The operation of the first energization control unit ECU1 shown in FIG. 5 will now be described. In the discussion to follow, when the key switch is in either the starter operating position or the ordinary engine operating position, the key switch is said in the ON state, and the key switch is said in the OFF state when it is in the engine stopping position.

Figure 6:
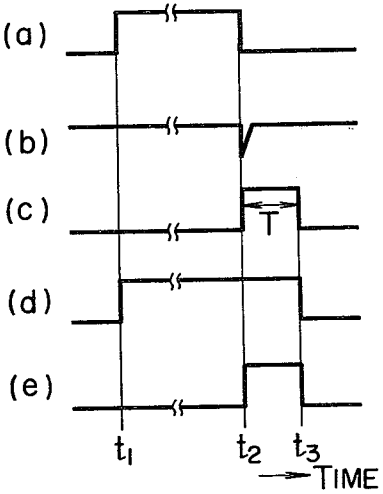
FIG. 6 is a characteristic diagram useful for explaining the operation of the circuitry shown in FIG. 5.

When a key switch 206 is turned on at a time $t_1$ in FIG. 6, the potential at a point A becomes equal to the supply voltage of a battery 207 so that the transistor 222 is turned on and the relay 224 is also closed closing its contacts 224*a*. In this case, the transistor 223 remains off due to the presence of the diode 230. When the key switch 206 is turned off at a time $t_2$ in FIG. 6, the potential at the point A decreases to the ground potential, so that in response to the transition of the potential the capacitor 204 generates at a point B the differentiation pulse shown in (b) of FIG. 6 and thus the IC 208 is triggered to generate the pulse shown in (c) of FIG. 6 from its No. 3 terminal (or at a point C).

The width T (in seconds) of this pulse is determined by the resistance value of the resistor 209*b* and the capacitance value of the capacitor 210, and if the IC 208 comprises the Raytheon model No. 555, then it is given as follows $$T(\text{sec}) = 1.1RC$$

where R is the resistance value (in ohms) of the resistor 209*b* and C is the capacitance value (in farads) of the capacitor 210.

By virtue of this pulse, even the key switch 206 is turned off, the transistor 222 remains on and the relay 224 is also held in the closed condition. Also the pulse turns the transistor 223 on so that the relay 225 is closed and the coil 100 is energized.

When the output pulse at the No. 3 terminal of the IC 208 goes to the low level at a time $t_3$ in FIG. 6, both the transistors 222 and 223 are turned off and similarly the relays 224 and 225 are opened, thus deenergizing the coil 100. When the relay 224 is opened, the current flow to the stabilizing supply circuit is cut off and this prevents the consumption of current while the engine is at rest.

The transistors 222 and 223 are also arranged so that they are turned on in response to any malfunctioning of the engine (not shown) or the fuel injection pump 4. More specifically, if the temperatures of the engine cooling water and the lubricating oil rise abnormally, a water temperature switch 226 and an oil temperature switch 227 for detecting such abnormal temperature rise are turned on and the potential at the point C increases. Consequently, the transistors 222 and 223 are turned on and the relays 224 and 225 are closed, thus energizing the coil 100.

On the other hand, when the rotational speed of the engine or the fuel injection pump 4 increases abnormally and exceeds a predetermined value, a speed switch 228 is turned on, and if the oil pressure of the lubricating oil decreases abnormally, an oil pressure switch 229 is turned on. The coil 100 is energized in either of the two cases.

Where the electromagnetic on-off valve 12 also has a function as a check valve as shown in FIGS. 3 and 4, the second energization control unit ECU2 may be such that it is simply turned on in response to the closing of the key switch 206.

The overall operation of the embodiment described above will now be described. When the key switch 206 is turned on so that the coil 120 of the on-off valve 12 is energized and the coil 100 of the selectro valve 1 is not energized, the fuel is supplied to the fuel injection pump 4 from the fuel tank 2 by way of the fuel lines 7, 8, 9, 10 and 11 and then the fuel is injected into the engine through the fuel injection valves 5 causing the engine to operate continuously.

When the key switch 206 is turned off, the coil 100 of the selector valve 1 is immediately energized. In this case, while the coil 120 of the on-off valve 12 is deenergized, the on-off valve 12 is adapted to function as a check valve and thus the fuel in the fuel injection pump 4 is returned to the fuel tank 2 through the fuel lines 11, 8, 9, 10 and 7. In other words, just after the opening of the key switch 206, the plunger 121 and the valve member 123 are moved against the spring 122 by the delivery pressure of the fuel supply pump 3 so that the on-off valve 12 is opened and the fuel is allowed to flow to the fuel tank 2. As a result, when the key switch 206 is turned off, the engine is stopped automatically so that at the expiration of a predetermined time just after the opening of the key switch 206, the coils 100 and 120 are both deenerigized and the on-off valve 12 is closed completely preventing the flow of the fuel to the fuel injection pump 4. Thus, even if any external force is applied, the engine is positively prevented from being started.

On the other hand, when any abnormal condition (e.g., the previously mentioned abnormal rise in cooling water temperature or the like) occurs while the engine is in operation, the coil 100 of the selector valve 1 is energized so that the fuel in the fuel injection pump 4 is returned to the fuel tank 2 and the engine is stopped.

Figure 7:
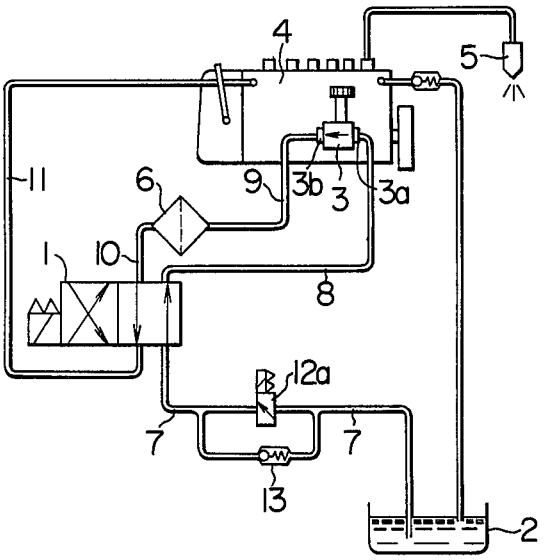
FIG. 7 is a schematic diagram showing the construction of another embodiment of the invention.

Referring now to FIG. 7, there is illustrated a second embodiment of the apparatus according to the invention. As shown in the Figure, the electromagnetic on-off valve 12*a* not adapted to function as a check valve and a check valve 13 may be arranged in parallel in the fuel line 7 (or the fuel line 11) to ensure the equivalent function as the electromagnetic on-off valve 12 shown in FIG. 3.

Figure 8:
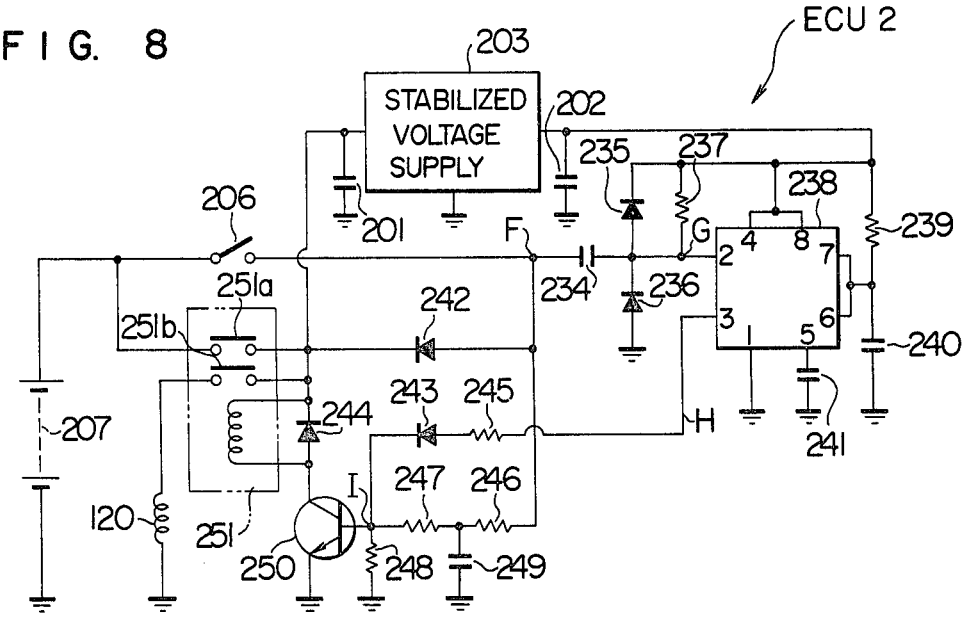
FIG. 8 is a circuit diagram showing an embodiment of the energization control unit ECU2 for electromagnetic on-off valve.

FIG. 8 shows an embodiment of the second energization control unit ECU2 of such type suited to control an electromagnetic on-off valve having no check valve function and adapted to function only as an on-off valve. In the Figure, the second energization control unit ECU2 for the coil 120 of the electromagnetic on-off valve 12 mainly comprises a stabilizing supply circuit, a monostable multivibrator and a relay drive circuit. The stabilizing supply circuit may be of the same type as shown in FIG. 5, and the monostable multivibrator is the same in circuit construction as the one shown in FIG. 5 comprising a differentiating capacitor 234, diodes 235 and 236, a resistor 237, a monostable multivibrator IC 238, an externally connected resistor 239, and capacitors 240 and 241.

The relay drive circuit comprises diodes 242 to 244, resistors 245 to 248, a capacitor 249, a transistor 250 and a normally-open relay 251 having two sets of contacts.

The operation of the second energization control unit ECU2 is as follows. When the key switch 206 is turned on at a time $t_1$ in FIG. 9, the potential at a point F becomes equal to the supply potential of the battery 207 so that the transistor 250 is turned on and the relay 251 is also closed, thus closing its contacts 251*a* and 251*b* and thereby energizing the coil 120.

Figure 9:
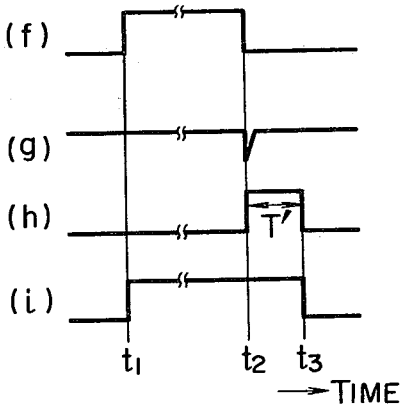
FIG. 9 is a characteristic diagram useful for explaining the operation of the circuitry shown in FIG. 8.

When the key switch 206 is turned off at a time $t_2$ in FIG. 9, the potential at the point F drops to the ground potential as shown in (f) of FIG. 9 so that in response to the transition of the potential the capacitor 234 generates the differentiation pulse shown in (g) of FIG. 9 at a point G and thus the IC 238 is triggered. Thus the pulse shown in (h) of FIG. 9 is generated from the No. 3 terminal of the IC 238 (or at a point H).

By virtue of this pulse, even the key switch 206 is turned off, the transistor 250 is held on for a time interval T' so that the relay 251 is also caused to remain on and the coil 120 is also kept energized.

When the output pulse of the IC 238 goes to the low level at a time $t_3$ in FIG. 9, the transistor 250 is turned off and the relay 251 is also opened thereby deenergizing the coil 120.

The operation of the entire apparatus incorporating this second energization control unit ECU2 will now be described. When the key switch 206 is turned on, the coil 120 of the electromagnetic on-off valve 12 is energized and the coil 100 of the electromagnetic selector valve 1 is not energized. Consequently, the fuel is supplied from the fuel tank 2 to the fuel injection pump 4 by way of the fuel lines 7, 8, 9, 10 and 11 and then the fuel is injected into the engine through the fuel injection nozzle 5 thus causing the engine to operate continuously.

When the key switch 206 is turned off, the coil 100 of the electromagnetic selector valve 1 is energized and the coil 120 of the electromagnetic on-off valve 12 is still energized. Thus the fuel in the fuel injection pump 4 is returned to the fuel tank 2 by way of the fuel lines 11, 8, 9, 10 and 7.

As a result, when the key switch 206 is turned off, the engine is stopped automatically. At the expiration of a predetermined time just after the opening of the key switch 206, both the coils 100 and 120 are deenergized so that the electromagnetic on-off valve 12 is closed and thus the fuel flow to the fuel injection pump 4 is cut off completely thereby positively preventing the engine from being started under the effect of any external force.

It will thus be seen from the foregoing that in accordance with this invention, by virtue of the fact that the electromagnetic selector valve 1 having a high current consumption is deenergized while the engine is in operation as well as at the expiration of a predetermined time after the engine has been stopped completely, there is no danger of causing the battery 207 to run down and also there is no need to use a high-power generator. Although the electromagnetic on-off valve 12 is energized during the operation of the engine, if the valve 12 is in the form of a poppet valve, for example, the stroke of about 2 mm at most will be sufficient with the resulting reduction in size and the current consumption will also be reduced to less than 1 ampere, thus practically giving rise to no problem.

While, in the above-described embodiments of the invention, the electromagnetic on-off valve 12 is disposed in the fuel pipe 7, the on-off valve 12 may for example be disposed in the fuel line 11 or in the passage 106*d* portion of the electromagnetic selector valve 1.

Further, the electromagnetic on-off valve 12 shown in FIG. 3 or the electromagnetic on-off valve 12*a* shown in FIG. 7 may be replaced with an on-off valve coupled to the key switch 206 by means of a wire, cam or the like so as to open or close the passage in the fuel line 7 (or the fuel line 11) in response to the operation of the key switch 206.

Further, while, in the embodiments of the invention, the electromagnetic selector valve 1 comprises a combination of a spool and a solenoid, it may comprise a combination of a rotary valve and a rotary solenoid.

Further, in the embodiment of the invention shown in FIG. 7, the check valve 13 may be of the poppet valve type or reed valve type and it may also be of the differential pressure valve type employing a diaphragm actuator.

We claim:

1. An apparatus for stopping an engine having a fuel supply pump, a fuel injection pump and a fuel tank, comprising:

an electromagnetic selector valve for connecting, when deenergized, a pipe line from said fuel tank to an inlet of said fuel supply pump and an outlet of said fuel supply pump to a pipe line from said fuel injection pump and for connecting, when energized, said pipe line from said fuel injection pump to said fuel supply pump inlet and said fuel supply pump outlet to said pipe line from said fuel tank;

electromagnetic valve means disposed in at least one of said pipe line from said fuel tank and said pipe line from said fuel injection pump so as to open and close a passageway therein, said valve means being adapted such that only the flow of fuel from said fuel injection pump to said fuel tank is allowed when said valve means is closed;

a first energization control unit connected to said electromagnetic selector valve and responsive to an on-to-off transition of a key switch of said engine to energize said electromagnetic selector valve for a predetermined time interval; and a second energization control unit connected to said valve means to open the same while said engine key switch is turned on.

2. A stop apparatus according to claim 1, wherein said valve means includes an electromagnetic on-off valve having both an on-off valve function and a check valve function.

3. A stop apparatus according to claim 1, wherein said valve means includes an on-off valve having only an on-off valve function, and a check valve disposed in parallel with said on-off valve.

4. A stop apparatus according to claim 2, wherein said electromagnetic on-off valve is mounted to a body portion of said electromagnetic selector valve.

5. A stop apparatus according to claim 2 or 3, wherein said first energization control unit includes:

a monostable multivibrator responsive to said on-to-off transition of said engine key switch to generate a pulse having a predetermined time width; and a relay circuit connected to said monostable multivibrator and electromagnetic selector valve and operable during the time said pulse of predetermined time width is generated from said monostable multivibrator so as to energize said electromagnetic selector valve.

6. A stop apparatus according to claim 5, wherein said relay circuit is operable in response to preselected operating conditions of said engine while said engine key switch is turned on.

7. An apparatus for stopping an engine having a fuel supply pump, a fuel injection pump and a fuel tank, comprising:

an electromagnetic selector valve for connecting, when deenergized, a pipe line from said fuel tank to an inlet of said fuel supply pump and an outlet of said fuel supply pump to a pipe line from said fuel injection pump and for connecting, when energized, said pipe line from said fuel injection pump to said fuel supply pump inlet and said fuel supply pump outlet to said pipe line from said fuel tank;

an electromagnetic on-off valve disposed in at least one of said pipe line from said fuel tank and said pipe line from said fuel injection pump to open and close a passageway therein;

a first energization control unit connected to said electromagnetic selector valve and responsive to an on-to-off transition of a key switch of said engine to energize said electromagnetic selector valve for a first predetermined time interval; and a second energization control unit connected to said electromagnetic on-off valve for opening said on-off valve while said engine key switch is turned on and for opening said on-off valve for a second predetermined time interval after said on-to-off transition of said key switch.

8. A stop apparatus according to claim 7, wherein said second energization control unit includes:

a monostable multivibrator responsive to said on-to-off transition of said engine key switch to generate a pulse having a time width corresponding to said second predetermined time interval; and a relay circuit connected to said monostable multivibrator and said electromagnetic on-off valve and operable while said key switch is turned on and during the time said pulse from said monostable multivibrator is generated so as to energize said electromagnetic on-off valve.

* * * * *